US011919694B2

(12) United States Patent
Walling et al.

(10) Patent No.: US 11,919,694 B2
(45) Date of Patent: Mar. 5, 2024

(54) ARTICLE TOP ENGAGING DEVICE, ARTICLE CARRIER AND BLANK THERFOR

(71) Applicant: WestRock Packaging Systems, LLC, Atlanta, GA (US)

(72) Inventors: Bradford J. Walling, Chesterfield, VA (US); Matthew E. Zacherle, Moseley, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 100 days.

(21) Appl. No.: 17/608,116

(22) PCT Filed: Apr. 22, 2020

(86) PCT No.: PCT/US2020/029258

§ 371 (c)(1),
(2) Date: Nov. 1, 2021

(87) PCT Pub. No.: WO2020/223075

PCT Pub. Date: Nov. 5, 2020

(65) Prior Publication Data

US 2022/0258943 A1 Aug. 18, 2022

Related U.S. Application Data

(60) Provisional application No. 62/841,432, filed on May 1, 2019.

(51) Int. Cl.
*B65D 71/50* (2006.01)

(52) U.S. Cl.
CPC ..... *B65D 71/504* (2013.01)

(58) Field of Classification Search
CPC ..... B65D 71/40; B65D 71/42; B65D 71/44; B65D 71/50; B65D 71/504; B65D 73/00; B65D 73/0042
USPC ..... 206/150
See application file for complete search history.

(56) References Cited

U.S. PATENT DOCUMENTS

| | | | |
|---|---|---|---|
| 2,823,062 | A | 10/1955 | Toensmeier |
| 2,929,181 | A | 3/1960 | Poupitch |
| 2,936,070 | A | 5/1960 | Poupitch |
| 3,137,109 | A | 6/1964 | Rapata |
| RE25,781 | E | 5/1965 | Akiereb |

(Continued)

FOREIGN PATENT DOCUMENTS

| | | | |
|---|---|---|---|
| AU | 2009200835 | A1 | 9/2009 |
| DE | 202018106535 | U1 | 2/2019 |

(Continued)

*Primary Examiner* — Bryon P Gehman
(74) *Attorney, Agent, or Firm* — Brian J. Goldberg; Rohini K. Garg

(57) ABSTRACT

Aspects of the disclosure relate to an article top engaging device 90*a*-90*d*, a carrier 90*a*-90*d* for packaging one or more articles B and a blank 1 for forming the carrier. The top engaging article carrier comprises an engaging panel having upper and lower panels 12,14 secured together in face-contacting relationship. The upper panel has at least one first top-engaging opening A1 of a first diameter and the lower panel has at least one second top engaging opening A2 of a second diameter. The first diameter is greater than the second diameter. Each of the first and second top-engaging openings is defined by a substantially circular, uninterrupted perimeter.

14 Claims, 4 Drawing Sheets

(56) References Cited

U.S. PATENT DOCUMENTS

| | | | | |
|---|---|---|---|---|
| 3,200,944 | A | | 8/1965 | Rapata |
| 3,242,631 | A | | 3/1966 | Whiteford |
| 3,317,234 | A | | 5/1967 | Burford |
| 3,515,272 | A | | 3/1968 | von Gal |
| 3,404,912 | A | | 10/1968 | Watts |
| 3,432,202 | A | | 3/1969 | Ebelhardt |
| 3,601,253 | A | | 8/1971 | Poupitch |
| 3,612,266 | A | | 10/1971 | Graser |
| 3,627,121 | A | | 12/1971 | Deasy |
| 3,664,497 | A | | 5/1972 | Mascia |
| 4,139,094 | A | | 2/1979 | Berry |
| 4,190,149 | A | | 2/1980 | Oliff et al. |
| 4,304,329 | A | | 12/1981 | Graser |
| 4,378,878 | A | | 4/1983 | Graser |
| 4,453,630 | A | | 6/1984 | Helms et al. |
| 4,456,180 | A | | 8/1984 | Klygis |
| 4,518,081 | A | | 5/1985 | de Larosiere |
| 4,592,466 | A | | 6/1986 | Walters |
| 4,646,917 | A | | 3/1987 | Schuster |
| 4,911,289 | A | | 3/1990 | Bird |
| 5,103,971 | A | | 4/1992 | Schuster |
| 5,125,506 | A | | 6/1992 | Glabierz et al. |
| 5,135,104 | A | | 8/1992 | Jorba |
| 5,186,321 | A | | 2/1993 | Fadus |
| 5,188,225 | A | | 2/1993 | Jorba |
| 5,209,346 | A | | 5/1993 | Pratt |
| 5,237,796 | A | | 8/1993 | Bonkowski |
| 5,255,780 | A | | 10/1993 | Olsen |
| 5,263,299 | A | | 11/1993 | Galbierz et al. |
| 5,297,673 | A | | 3/1994 | Sutherland |
| 5,320,216 | A | | 6/1994 | Pangborn |
| 5,323,895 | A | | 6/1994 | Sutherland et al. |
| 5,415,278 | A | | 5/1995 | Sutherland |
| 5,474,172 | A | | 12/1995 | Zavatone et al. |
| 5,484,053 | A | | 1/1996 | Harris |
| 5,485,914 | A | | 1/1996 | Martin |
| 5,487,464 | A | | 1/1996 | Galbierz et al. |
| 5,551,556 | A | | 9/1996 | Sutherland |
| 5,551,566 | A | | 9/1996 | Sutherland |
| 5,553,704 | A | | 9/1996 | Gordon et al. |
| 5,553,705 | A | | 9/1996 | Bakx |
| 5,573,111 | A | | 11/1996 | Gordon |
| 5,627,150 | A | | 5/1997 | Peterson |
| 5,639,137 | A | | 6/1997 | Bakx |
| 5,706,936 | A | | 1/1998 | Bernstein |
| 5,711,419 | A | * | 1/1998 | Beales ..... B65D 71/40 206/148 |
| 5,718,330 | A | | 2/1998 | Auffret |
| 5,791,463 | A | | 8/1998 | Negelen |
| 5,791,464 | A | | 8/1998 | Galbierz et al. |
| 5,845,776 | A | | 12/1998 | Galbierz et al. |
| 6,039,181 | A | | 3/2000 | Whiteside |
| 6,076,331 | A | * | 6/2000 | Granbakken ..... B65D 71/42 53/398 |
| 6,168,012 | B1 | | 1/2001 | Galbierz |
| 6,293,392 | B1 | | 9/2001 | Galbierz |
| 6,658,815 | B1 | | 12/2003 | Gaspar |
| 7,144,635 | B2 | | 12/2006 | Hawes |
| 7,377,382 | B2 | | 5/2008 | Borg |
| 8,113,968 | B2 | | 2/2012 | Fittler |
| 8,162,135 | B2 | | 4/2012 | Oliveira |
| 8,443,968 | B2 | | 5/2013 | de Paula |
| 9,004,344 | B2 | | 4/2015 | Smith |
| D786,702 | S | | 5/2017 | Borg et al. |
| 10,293,998 | B2 | | 5/2019 | Borg |
| 2004/0007480 | A1 | | 1/2004 | Pattee et al. |
| 2004/0134799 | A1 | | 7/2004 | Mattson |
| 2007/0193889 | A1 | | 8/2007 | Olsen et al. |
| 2007/0202324 | A2 | | 8/2007 | Hawes |
| 2012/0080328 | A1 | | 4/2012 | DePaula |
| 2016/0159546 | A1 | | 6/2016 | Cassidy |
| 2016/0280436 | A1 | | 9/2016 | Taylor et al. |
| 2018/0362234 | A1 | | 12/2018 | L'Heureux |
| 2019/0119019 | A1 | | 4/2019 | Patton |

FOREIGN PATENT DOCUMENTS

| | | | |
|---|---|---|---|
| EP | 0398835 | B1 | 10/1996 |
| EP | 1075219 | B1 | 10/2003 |
| EP | 2067713 | A1 | 10/2009 |
| ES | 2159235 | B1 | 9/2001 |
| GB | 1427510 | | 3/1976 |
| GB | 2287448 | A | 9/1995 |
| WO | 1993021083 | A1 | 10/1993 |
| WO | 1997018993 | A1 | 5/1997 |
| WO | 2009023822 | A1 | 2/2009 |
| WO | 2016008744 | A1 | 1/2016 |

* cited by examiner

ARTICLE TOP ENGAGING DEVICE, ARTICLE CARRIER AND BLANK THERFOR

TECHNICAL FIELD

The present invention relates to article top engaging devices, article carriers and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides a top engaging article carrier comprising an engaging panel having upper and lower panels secured together in face-contacting relationship. The upper panel has at least one first top-engaging opening of a first diameter and the lower panel has at least one second top engaging opening of a second diameter. The first diameter is greater than the second diameter. Each of the first and second top-engaging openings may be defined by a substantially circular, uninterrupted perimeter.

Optionally, the upper panel comprises at least one first fold line extending from the at least one first top-engaging opening to a free edge thereof.

Optionally, the lower panel comprises at least one second fold line extending from the at least one second top-engaging opening to a free edge thereof.

Optionally, the lower panel comprises at least one second fold line extending from the at least one second top-engaging opening to a free edge thereof, the at least one second fold line is disposed in registry with the at least one first fold line in the upper panel.

A second aspect of the invention provides a package formed from the combination of a top engaging article carrier and at least one article. The article carrier comprises an engaging panel having upper and lower panels secured together in face-contacting relationship. The upper panel has at least one first top-engaging opening of a first diameter and the lower panel has at least one second top engaging opening. The article comprises an upper end having a third diameter. The first diameter may be greater than the third diameter by less than twice the thickness of the substrate forming the lower panel.

A third aspect of the invention provides a package formed from the combination of a top engaging article carrier and at least one article. The article carrier comprises an engaging panel having upper and lower panels secured together in face-contacting relationship. The upper panel has at least one first top-engaging opening of a first diameter and the lower panel has at least one second top engaging opening of a second diameter. The first diameter is greater than the second diameter. The article comprises an upper end having a third diameter. The first diameter is greater than the third diameter by less than twice the thickness of the substrate forming the lower panel.

A fourth aspect of the invention provides a blank for forming an article carrier, the blank comprising a first panel and a second panel, the first panel having at least one first top-engaging opening of a first diameter and the second panel having at least one second top engaging opening of a second diameter, wherein the first diameter is greater than the second diameter, each of the first and second top-engaging openings may be defined by a substantially circular, uninterrupted perimeter.

A fifth aspect of the invention provides a blank for forming an article carrier, the blank comprising a first panel and a second panel hingedly connected to the first panel by a hinged connection, the first panel having at least one first top-engaging opening of a first diameter and the second panel having at least one second top engaging opening of a second diameter, wherein the first diameter is greater than the second diameter, each of the first and second top-engaging openings may be defined by a substantially circular, uninterrupted perimeter.

Optionally, the hinged connection is frangible.

A sixth aspect of the invention provides a blank for forming two or more article carriers, the blank comprising a plurality of first panels and a plurality of second panels hingedly connected to the plurality of first panels by a hinged connection so as to be foldable into face to face relationship with the plurality of first panels, each of plurality of first panels having at least one first top-engaging opening of a first diameter and the each of plurality of second panels having at least one second top engaging opening of a second diameter, wherein the first diameter is greater than the second diameter, wherein each of the plurality of first panels is frangibly connected to an adjacent one of the plurality of first panels, and wherein each of the plurality of second panels is frangibly connected to an adjacent one of the plurality of second panels.

Optionally, each of the first and second top-engaging openings may be defined by a substantially circular, uninterrupted perimeter.

Optionally, the hinged connection is frangible.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
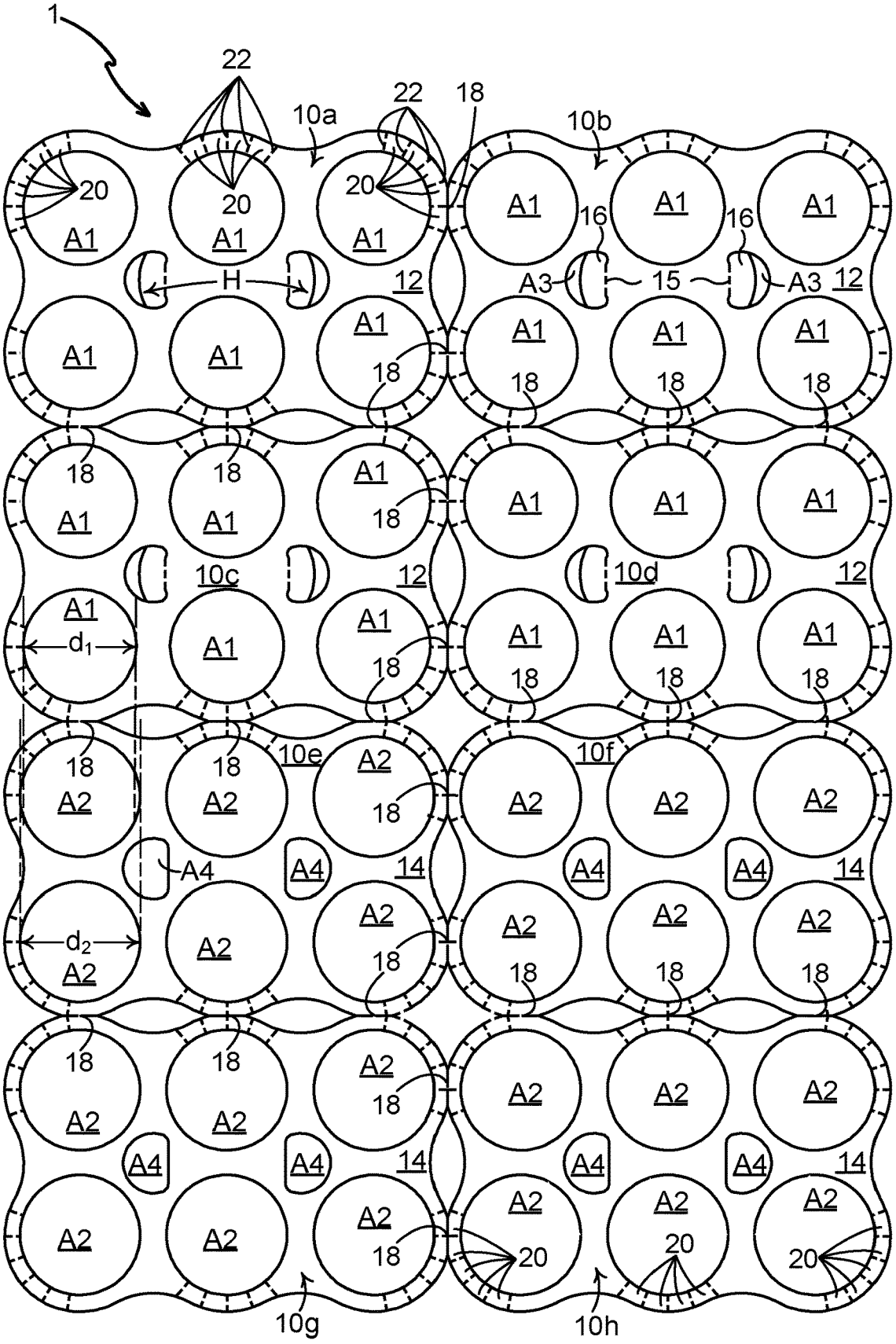
FIG. 1 is a plan view from above of a plurality of connected blanks, each blank capable of forming part of an article carrier according to a first embodiment.
Figure 3:
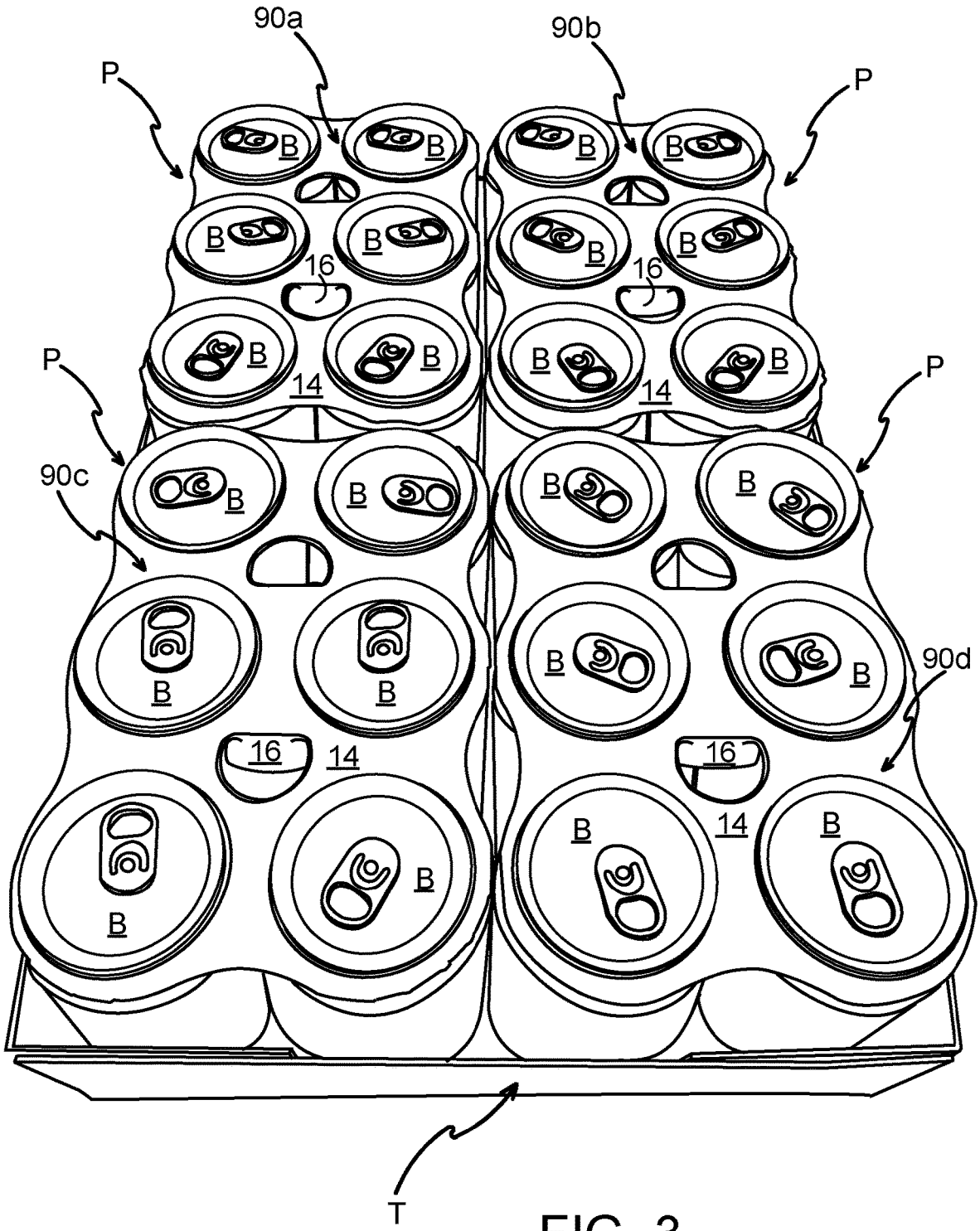
FIG. 3 is a perspective view from above of a plurality of articles carriers formed from the plurality of connected blanks of FIG. 1 applied to a group of articles to form packages.

Referring to FIG. 1, there is shown a plan view of a plurality of connected blanks denoted generally by reference sign 1; the plurality of connected blanks 1 form article carriers 90*a*, 90*b*, 90*c*, 90*d*, as shown in FIG. 3, for containing and carrying a group of primary products such as, but not limited to, bottles or cans, hereinafter referred to as articles B, as shown in FIG. 3. The article carriers 90*a*, 90*b*, 90*c*, 90*d* each form a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminum cans), tins, pouches, packets and the like.

The plurality of connected blanks 1 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the plurality of connected blanks 1 is configured to form cartons or carriers 90*a*, 90*b*, 90*c*, 90*d* for packaging an exemplary arrangement of exemplary articles B. In the embodiment illustrated in FIG. 1 the arrangement is a 2×3 matrix or array; in the illustrated embodiment two rows of three articles are provided, and the articles B are beverage cans. Alternatively, the plurality of connected blanks 1 can be configured to form carriers for packaging other types, number and size of articles and/or for packaging articles in a different arrangement or configuration.

Referring to FIG. 1 there is shown a plurality of connected blanks referred to generally by reference sign 1, specifically there are eight blanks 10*a*, 10*b*, 10*c*, 10*d*, 10*e*, 10*f*, 10*g*, 10*h* arranged in a 4×2 matrix or array. Each blank 10*a*, 10*b*, 10*c*, 10*d*, 10*e*, 10*f*, 10*g*, 10*h* comprises a main panel 12, 14 for forming a layer of an engaging panel of a carrier 90*a*, 90*b*, 90*c*, 90*d* (see FIG. 3). Each blank 10*a*, 10*b*, 10*c*, 10*d*, 10*e*, 10*f*, 10*g*, 10*h* is connected to at least two adjacent blanks 10*a*, 10*b*, 10*c*, 10*d*, 10*e*, 10*f*, 10*g*, 10*h* by frangible connections 18.

The plurality of connected blanks 1 comprises at least one first blank 10*a*, 10*b*, 10*c*, 10*d* and at least one second blank 10*e*, 10*f*, 10*g*, 10*h*. The at least one first blank 10*a*, 10*b*, 10*c*, 10*d* may be hingedly connected to the at least one second blank 10*e*, 10*f*, 10*g*, 10*h*. The hinged connection may be provided by a frangible connection 18 between the at least one first blank 10*a*, 10*b*, 10*c*, 10*d* and the at least one second blank 10*e*, 10*f*, 10*g*, 10*h*.

The illustrated embodiments comprises four first blanks 10*a*, 10*b*, 10*c*, 10*d* and four second blanks 10*e*, 10*f*, 10*g*, 10*h*. Two of the first blanks 10*a*, 10*b*, 10*c*, 10*d* are hingedly connected to two of the second blanks 10*e*, 10*f*, 10*g*, 10*h*.

The first blanks 10*a*, 10*b*, 10*c*, 10*d* form a first layer or ply of an engaging panel of a carrier 90*a*, 90*b*, 90*c*, 90*d*. The second blanks 10*e*, 10*f*, 10*g*, 10*h* form a second layer or ply of the engaging panel of a carrier 90*a*, 90*b*, 90*c*, 90*d*.

Each of the main panels 12 of the first blanks 10*a*, 10*b*, 10*c*, 10*d* comprise at least one first article receiving aperture A1. In the illustrated embodiment the main panels 12 comprise six first article receiving apertures A1 arranged in a 3×2 matrix or array.

Each of the first article receiving apertures A1 is circular in shape and comprises a first diameter $d_1$.

The main panels 12 of the first blanks 10*a*, 10*b*, 10*c*, 10*d* optionally comprises fold or score lines 22. The fold lines 22 extend from the first article receiving apertures A1. The fold lines 22 may extend radially outward from the first article receiving apertures A1. The fold lines 22 may extend across the main panel 12 to a free edge of the main panel 12.

The main panels 12 of the first blanks 10*a*, 10*b*, 10*c*, 10*d* optionally comprise a handle structure H. The handle structure H comprises at least one first finger opening A3. The illustrated handle structure H comprises two first finger openings A3. The finger openings A3 may be defined in part by a cushioning flap 16 hingedly connected to the main panel 12 by a hinged connection in the form of a fold line 15. The cushioning flaps 16 of the pair of first finger openings A3 may be arranged to be hinged in opposition to each other.

Each of the main panels 14 of the second blanks 10*e*, 10*f*, 10*g*, 10*h* comprise at least one second article receiving aperture A2. In the illustrated embodiment the main panels 14 comprise six second article receiving apertures A2 arranged in a 3×2 matrix or array.

Each of the second article receiving apertures A2 is circular in shape and comprises a second diameter $d_2$. The second diameter $d_2$ is greater than the first diameter $d_1$.

The main panels 14 of the second blanks 10*e*, 10*f*, 10*g*, 10*h* optionally comprises fold or score lines 22. The fold lines 22 extend from the second article receiving apertures A2. The fold lines 22 may extend radially outward from the second article receiving apertures A2. The fold lines 22 may extend across the main panel 14 to a free edge of the main panel 14.

The fold lines 22 provided in the main panels 14 of the second blanks 10*e*, 10*f*, 10*g*, 10*h* may be arranged to be in vertical registry with the fold lines 22 provided in the main panels 12 of the first blanks 10*a*, 10*b*, 10*c*, 10*d*.

The main panels 14 of the second blanks 10*e*, 10*f*, 10*g*, 10*h* optionally comprise a handle structure. The handle structure comprises at least one second finger opening A4. The illustrated handle structure comprises two second finger openings A4. Each of the second finger opening A4 is arranged to be in vertical registry with a respective one of the first finger openings A3. The second finger openings A4 may be larger in dimension than the first finger openings A3.

The first article receiving apertures A1 and the second article receiving apertures A2 form article retention structures or article top engaging devices.

Optionally, the side edges of the main panel 12 may be arranged in a curvilinear or undulating shape. In this way, a first blank 10 may be arranged in a nested arrangement with a second blank 10. The undulating shape provides that the first and second blanks 10 together define a width which is less than twice the maximum width of an individual blank 10. This may have economic and environmental benefit by reducing the amount of substrate required to produce a given number of blanks 10.

The main panels 12, 14 include at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 27 point (pt.) (1 pt=0.001"=0.025 mm) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

Figure 2:
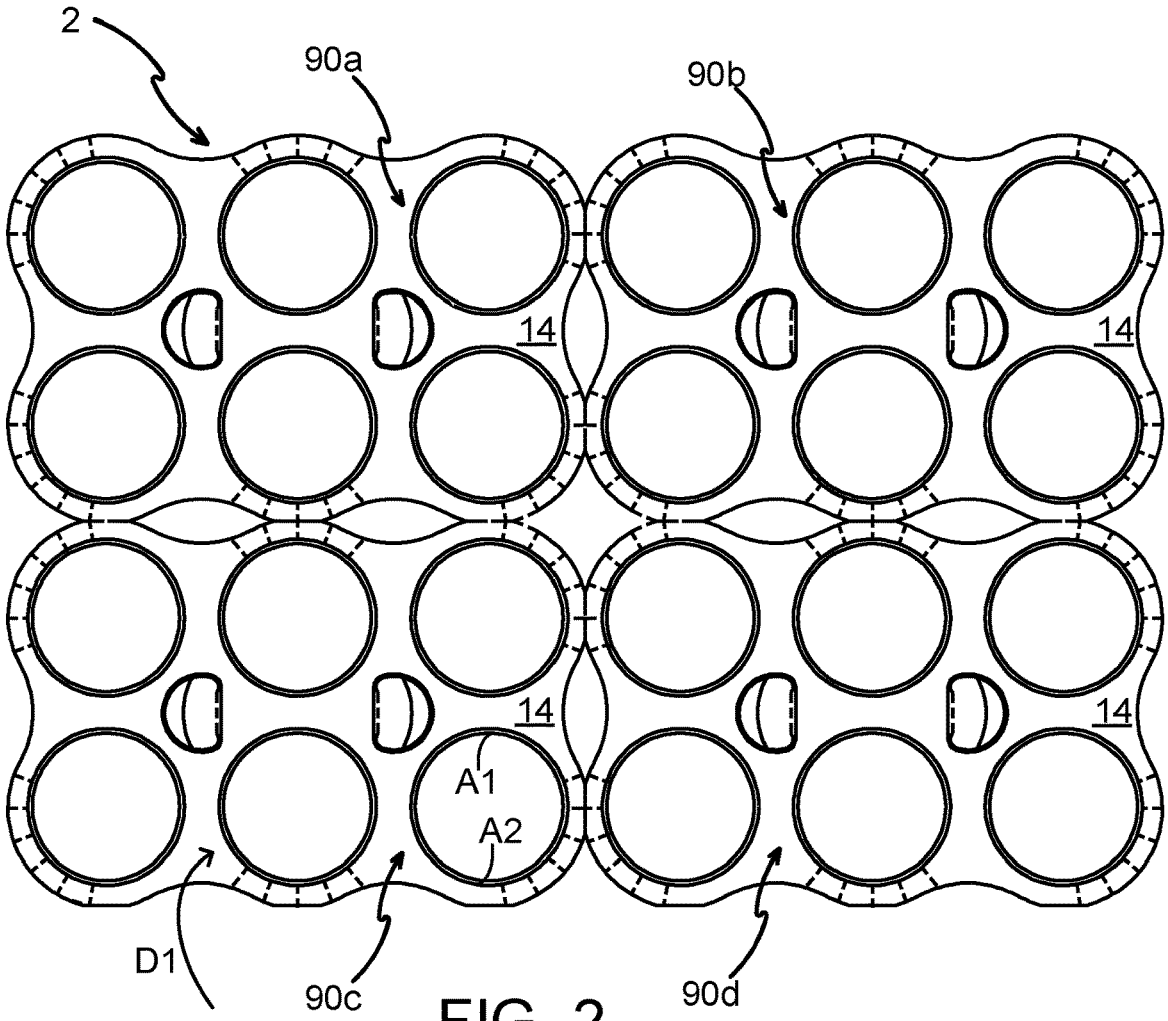
FIG. 2 is a plan view from above the plurality of connected blanks of FIG. 1 in a stage of construction into article carriers.

In order to form an article carrier 90*a*, 90*b*, 90*c*, 90*d*, the plurality of connected blanks 1 is folded about a hinged connection between the group of first blanks 10*a*, 10*b*, 10*c*, 10*d* and the group of second blanks 10*e*, 10*f*, 10*g*, 10*h* as indicated by direction arrow D1 in FIG. 2. The group of second blanks 10*e*, 10*f*, 10*g*, 10*h* is brought into face contacting relationship with the group of first blanks 10*a*, 10*b*, 10*c*, 10*d* and secured thereto by glue or other suitable adhesive treatment. In this way a plurality of article carriers 90*a*, 90*b*, 90*c*, 90*d* is formed.

A first layer of paperboard having coating on one side is bonded to a second layer of paperboard having a coating on one side. The uncoated side of the first layer is bonded to the uncoated side of the second layer with an adhesive treatment or glue. In alternative embodiments, the coated side of the first layer may be bonded to the coated side of the second layer with an adhesive treatment or glue. In one example a first blank 10*a*, 10*b*, 10*c*, 10*d* comprised of a 27 pt CBS or CNK board is bonded to a second blank 10*e*, 10*f*, 10*g*, 10*h* comprised of a 27 pt CBS or CNK board. This produces a substrate having a thickness of about 0.054" around 1.4 mm having coating on opposing faces thereof. An advantage of such a substrate is increased strength without the inclusion of a polymeric material or plastics material, such substrates may provide environmental benefit and be more easily recycled.

In some embodiments at least one tear resistant layer may be disposed between the first and second layers of the substrate, such a substrate may be formed by bonding two sheets of material at least one of which comprises a tear resistant layer laminated thereto. This may have the advantage of increasing the strength of the substrate.

Packages P are formed from the article carriers 90*a*, 90*b*, 90*c*, 90*d* and groups of articles B. The article carriers 90*a*, 90*b*, 90*c*, 90*d* may be applied to a group of articles B. A plurality of carriers denoted generally by reference sign 2 in FIG. 2 is lowered with respect to a plurality of articles B.

Each of the article retention structures of the plurality of carriers 2 aligned with a respective article B in the plurality of articles B. Portions of the articles B pass through the main panels 12, 14.

Each main panel 12 may be folded or deformed about the articles B received in the respective ones of the article retention structures, the fold lines 22 may facilitate the deformation of the article carriers 90*a*, 90*b*, 90*c*, 90*d* about the articles B for example but not limited to a shoulder portion of the article, where the article B is a can the shoulder portion may be provide by the neck-in.

The edge of the first article receiving apertures A1 forms a supporting or engaging edge for supporting or engaging with an article B. The edge of second article receiving apertures A2 may form a die, guide, mold or mandrel facilitating deformation of a region of the main panel 12.

Figure 4:
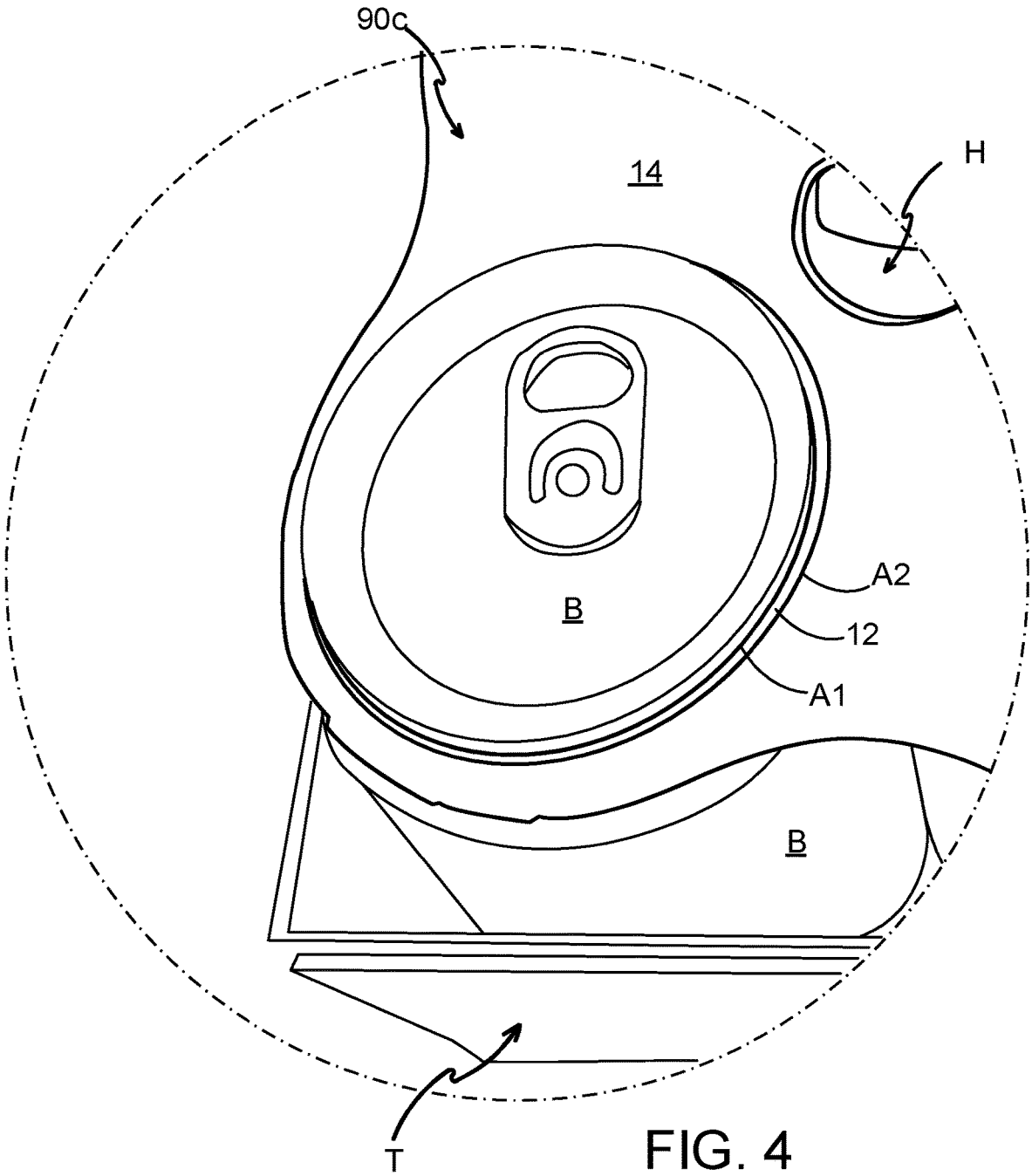
FIG. 4 is an enlarged plan view of a portion of one of the article carriers of FIG. 3 showing an article retention structure.

The article retention structures comprise an annular region provided by the main panel 12 of the first blanks 10*a*, 10*b*, 10*c*, 10*d*. This annular region is defined between an edge of each of the first article receiving apertures A1 and the edge of a corresponding one of the second article receiving apertures A2, best illustrated in FIGS. 2 and 4.

The annular region may deform about an article B as it is received in the article retention structures.

The edges of second article receiving apertures A2 may define an end stop limiting deformation, tearing or delamination of the substrate of the main panels 12 when the articles B are received in the article retention structures.

The annular regions provided by the main panel 12 of the first blanks 10*a*, 10*b*, 10*c*, 10*d* when deformed may fold or deform upwardly into the second article receiving apertures A2 so as the be disposed between the edge of second article receiving apertures A2 and the respective article B received in the article retention structures.

The annular region provided by the main panel 12 of the first blanks 10*a*, 10*b*, 10*c*, 10*d* may be squeezed between the article B, for example but not limited to the neck of the article B, and the aperture A2 of the main panel 14. The annular region provided by the main panel 12 of the first blanks 10*a*, 10*b*, 10*c*, 10*d* may provide a seal or wedge between the main panel 14 and the article B.

In one example the apertures A1 may have a diameter $d_1$ of around 2" (50.8 mm) and the apertures A2 may have a diameter $d_2$ of around 2⅛" (54 mm), the article B may be a 202/211 standard can having a body diameter of about 2.6" (66 mm) and an end cap dimension $EC_d$ of about 2.13" (54 mm).

In this way upper end of the article B may freely pass through aperture A2 in the main panel 14. The upper end of the article B cannot pass through aperture A1 in the main panel 12 without deforming the main panel 12.

Figure 5:
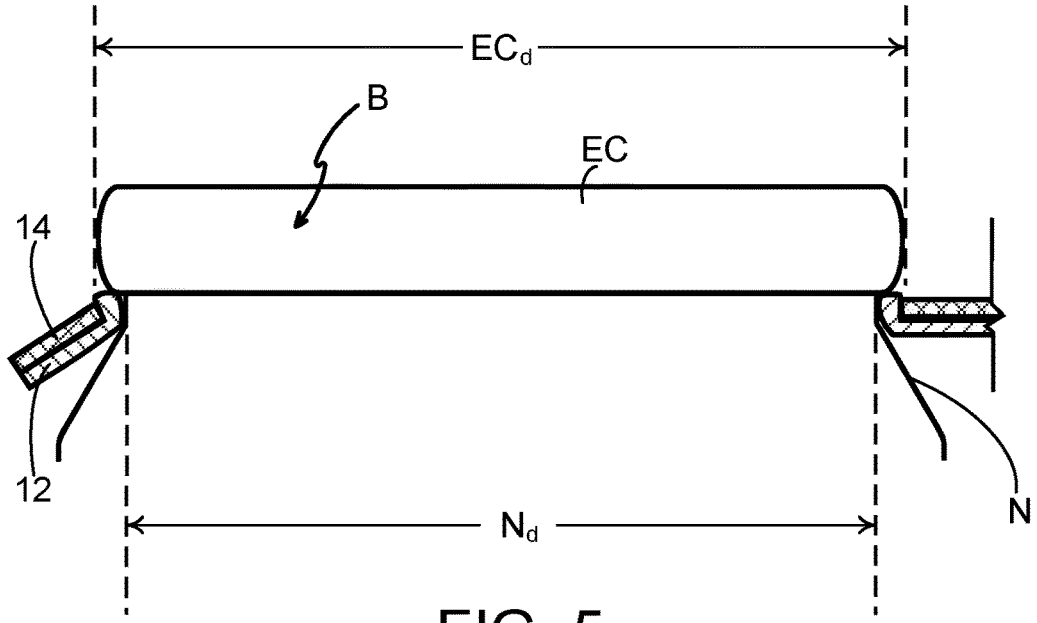
FIG. 5 is a schematic illustration of a portion of an article carrier engaging an article.

The portion of the neck N (see FIG. 5) of the article B proximate the end cap EC is smaller in diameter $N_d$ than the end cap diameter $EC_d$ so as to provide the flange or protrusion. The portion of the neck N of the article B proximate the end cap EC may comprise a diameter $N_d$ which is smaller than the end cap diameter $EC_d$ by less than or equal to about twice the thickness of the substrate forming the main panel 12.

The neck diameter $N_d$ may be larger than the diameter $d_1$ of the apertures A1.

The edge of the main panel 12 defined by the aperture A1 forms a supporting edge for engaging beneath a projection of an article B. The projection may be located about the neck or chime of the article B (which may provide a flange) of an article B. When the article B is a can the projection may be provided by a canner's end seam. In other embodiments it may be provided by a ridge or undercut shaping of the article B or by an end closure of the article B for example but not limited to a crown cork or closure. In this way, the supporting edge grips or holds the article B and prevents or inhibits the article B from unintentionally separating from the article carrier 90*a*, 90*b*, 90*c*, 90*d*.

In some embodiments the main panel 12 may comprise one or more relief notches or cutaways to facilitate deformation of the article carrier 90*a*, 90*b*, 90*c*, 90*d* about an article B.

The cutaways may be substantially "U" shaped, in other embodiments the cutaways may be alternatively shaped such as but not limited to "V" shaped. The cutaways extend radially outward from the aperture A1.

The cutaways form relief elements extending radially away from the center of the aperture A1.

In embodiments in which two or more relief notches are provided, two adjacent relief elements of the supporting edge are tangentially contacted by a notional tangential line. The notional tangential line passes through respective tangential contacting points on the two adjacent relief elements of the supporting edge. The notional tangential line contacts or intersects with a notional circle defined generally by the aperture A1.

In embodiments in which two or more relief elements are provided about the perimeter of the aperture A1 a curvilinear or arcuate section of the supporting edge is disposed between two adjacent relief elements. The arcuate section may be defined by a notional circle centered at the center of the aperture A1.

Another optional feature of the carrier 90*a*, 90*b*, 90*c*, 90*d* is that the engaging panel 12/14 is defined by a perimeter to which no other part of the carrier 90*a*, 90*b*, 90*c*, 90*d* is connected. That is to say, the carrier 90*a*, 90*b*, 90*c*, 90*d* is free of connection to other panels for example, but not limited to, side or end wall panels which extend about the sides of the article group. The perimeter of the engaging panel 12/14 is therefore defined in its entirety by free, cut or unhinged edges.

Another optional feature of the carrier 90*a*, 90*b*, 90*c*, 90*d* is that the main panel 12 is defined by a perimeter including convexly curved edges and concavely curved edges, wherein the radius of curvature of the convexly curved edges is substantially equal to the radius of curvature of the concavely curved edges, thus allowing two similar blanks 10 to be placed in a nested or tessellated arrangement.

In some embodiments the plurality of carriers 2 is applied simultaneously to a first group of articles B. The first group of articles B is divisible into a plurality of second groups of articles B. Each second group of articles B is thus formed from a subset of the first group of articles B. The embodiment illustrated in FIG. 1 the first group of articles B comprises twenty-four articles arranged in a 4×6 matrix or array, and each carrier 90*a*, 90*b*, 90*c*, 90*d* accommodates six articles in a 3×2 matric or array.

The frangible connections 18 between the blanks 10*a*, 10*b*, 10*c*, 10*d*, 10*e*, 10*f*, 10*g*, 10*h* may separate upon application of the plurality of carriers 2 to the first group of articles B. Alternatively, the frangible connections 18 may remain intact, the carriers 90*a*, 90*b*, 90*c*, 90*d* may be separated from the others at a point of sale or distribution.

The present disclosure provides a carrier of the top engaging type having improved article retention structures or article top engaging devices.

The top engaging carrier comprises upper and lower panels or layers secured together in face-contacting relationship. The upper layer or panel has at least one first top-engaging opening of a first diameter and the lower panel or layer has at least one second top engaging opening of a second diameter. The first diameter is greater than the second diameter. Each of the first and second top-engaging openings may be defined by a substantially circular, uninterrupted perimeter.

The at least one second top engaging top-engaging opening may comprises one or more relief notches to facilitate deformation of the lower panel or layer. A portion or annular region of the lower panel or layer may pass through the at least one first top-engaging opening in the upper layer or panel.

The upper and lower panels or layers may form or deform from a planar structure to adopt a shape similar to that of the article B. The upper and lower panels or layers or portions thereof may adopt the shape of a can chime and/or tapered region of a neck or shoulder of the can. In this way the upper and lower panels or layers may mould about the neck-in region of the can. The article carrier 90*a*, 90*b*, 90*c*, 90*d* may retain, at least in part, the moulded shape when disengaged from the article or articles B.

The at least one first top-engaging opening upper layer or panel may have a diameter $d_2$ which is greater than the diameter $EC_d$ of the end of the article B by less than twice the thickness of the substrate forming the lower panel or layer.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A top engaging article carrier comprising an engaging panel having an upper panel and a lower panel secured together in face-contacting relationship, the upper panel having at least one first top-engaging opening of a first diameter and the lower panel having at least one second top engaging opening of a second diameter, wherein the first diameter is greater than the second diameter, each of the first and second top-engaging openings is defined by a substantially circular, uninterrupted perimeter.

2. A top engaging article carrier according to claim 1 wherein the upper panel comprises at least one first fold line extending from the at least one first top-engaging opening to a free edge thereof.

3. A top engaging article carrier according to claim 1 wherein the lower panel comprises at least one second fold line extending from the at least one second top-engaging opening to a free edge thereof.

4. A top engaging article carrier according to claim 2 wherein the lower panel comprises at least one second fold line extending from the at least one second top-engaging opening to a free edge thereof, the at least one second fold line being disposed in registry with the at least one first fold line in the upper panel.

5. A package formed from the combination of a top engaging article carrier and at least one article, the article carrier comprising an engaging panel having an upper panel and a lower panel secured together in a face-contacting relationship with a hinged connection joining the upper panel and the lower panel together, the upper panel having at least one first top-engaging opening of a first diameter and the lower panel having at least one second top engaging opening, wherein the at least one article comprises an upper end having a third diameter, and wherein the first diameter is greater than the third diameter by less than twice the thickness of the substrate forming the lower panel.

6. A package according to claim 5, wherein the at least one second top engaging opening has a second diameter, and wherein the first diameter is greater than the second diameter.

7. A blank for forming at least one article carrier, the blank comprising a first panel and a second panel hingedly connected to the first panel by a hinged connection therebetween so as to be foldable into face to face relationship with the first panel, the first panel having at least one first top-engaging opening of a first diameter and the second panel having at least one second top engaging opening of a second diameter, wherein the first diameter is greater than the second diameter, each of the first and second top-engaging openings being defined by a substantially circular, uninterrupted perimeter.

8. A blank according to claim 7, wherein the hinged connection is frangible.

9. A blank according to claim 7, wherein the blank is for forming two or more article carriers, wherein the blank comprises a plurality of first panels and a plurality of second panels hingedly connected to the plurality of first panels, respectively, by a hinged connection so as to be foldable into face to face relationship with the plurality of first panels, each of the plurality of first panels having at least one first top-engaging opening of the first diameter and each of the plurality of second panels having at least one second top engaging opening of the second diameter, wherein each of the plurality of first panels is frangibly connected to an adjacent one of the plurality of first panels, and wherein each of the plurality of second panels is frangibly connected to an adjacent one of the plurality of second panels.

10. A blank according to claim 9 wherein each of the first and second top-engaging openings of each of the plurality of first panels and the plurality of second panels, respectively, is defined by a substantially circular, uninterrupted perimeter.

11. A blank according to claim 9 wherein the hinged connection is frangible.

12. A blank according to claim 7, wherein the first panel comprises at least one first fold line extending from the at least one first top-engaging opening to a free edge of the first panel.

13. A blank according to claim 12, wherein the second panel comprises at least one second fold line extending from the at least one second top-engaging opening to a free edge of the second panel, each of the at least one second fold line being disposed in mirrored relationship with a corresponding one of the at least one first fold line of the first panel so as to be disposed in registry with the corresponding one of the at least one first fold line upon the second panel being folded into face to face relationship with the first panel to form the carrier.

14. A blank according to claim 7, wherein the second panel comprises at least one second fold line extending from the at least one second top-engaging opening to a free edge of the second panel.

* * * * *